United States Patent [19]

Lunden et al.

[11] 4,148,040

[45] Apr. 3, 1979

[54] HIGH RESOLUTION SIDE-LOOKING AIRBORNE RADAR ANTENNA

[75] Inventors: Clarence D. Lunden, Federal Way; Walter E. Buehler, Issaquah, both of Wash.

[73] Assignee: The Boeing Company, Seattle, Wash.

[21] Appl. No.: 738,703

[22] Filed: Nov. 3, 1976

[51] Int. Cl.[2] ..... H01Q 1/28; H01Q 19/06; H01Q 19/12

[52] U.S. Cl. ..... 343/708; 343/753; 343/755; 343/840

[58] Field of Search ..... 343/705, 706, 708, 753, 343/755, 771, 754, 840

[56] References Cited

U.S. PATENT DOCUMENTS

| | | | |
|---|---|---|---|
| 2,609,505 | 9/1952 | Pippard | 343/754 |
| 2,705,753 | 4/1955 | Jaffe | 343/754 |
| 2,995,740 | 8/1961 | Shreckengost | 343/705 |
| 3,656,164 | 4/1972 | Rempt | 343/705 |

OTHER PUBLICATIONS

"Piggy-Back Flying Saucer Tested," The Washington Post & Times Herald, Friday, Aug. 10, 1956, p. 16.

*Primary Examiner*—Alfred E. Smith
*Assistant Examiner*—Harry Barlow
*Attorney, Agent, or Firm*—Thomas H. Murray; Clifford A. Poff

[57] ABSTRACT

A feed horn mounted within a streamlined enclosure upon the top surface of a wing of an aircraft at an outwardly-spaced location to direct electromagnetic wave energy toward the face surface of a dielectric slim lens having a metallic reflector between the lens and the fuselage of the aircraft to effect a double-traversal of the incident wave energy. The metallic reflector is planar or parabolic to trim the aerodynamic cross section. When the metal skin of the fuselage is used as the reflector, the dielectric constant of the lens is modified by varying its thickness to produce a very sharp beam by compensating for the curvature of the fuselage at the lens support site.

11 Claims, 4 Drawing Figures

HIGH RESOLUTION SIDE-LOOKING AIRBORNE RADAR ANTENNA

BACKGROUND OF THE INVENTION

This invention relates to providing a high resolution side-looking airborne radar antenna by a modification in an airworthy fashion of the straight planiform fuselage of a modern airliner, together with the wing to produce a high gain, very low-side lobe fixed beam from a ray-fed lens structure which is essentially frequency insensitive. More particularly, the lens structure includes a half-lens in double-traversal over a flat metal reflector, or a similar double-traversal lens in a metal parabolic dish to trim the aerodynamic cross section.

Modern high resolution radar dictates the requirement for large antenna apertures to generate narrow microwave beams. The apertures typically required for such a radar are between 6 to 10 feet in diameter. For airborne applications, an aperture of this size generates both technical as well as cost problems. When a seven-foot diameter parabolic dish was mated with the nose cone of a jet aircraft, it was found necessary to carry out extensive structural modifications at high cost and the resulting configuration of the aircraft produced excessive drag.

When the mission permits the use of a side-looking radar, such as a severe weather probe and hurricane mapping, a much less expensive and highly effective antenna is desirable as an alternative to a conventional nose cone mounted parabolic dish antenna. Microwave lenses are per se known in the art as shown, for example, in U.S. Pat. No. 2,705,753.

SUMMARY OF THE INVENTION

It is an object of the present invention to provide a high resolution side-looking radar antenna with a streamlined, low-drag configuration useful for mapping and probing weather cells at a substantially reduced cost over that normally required for modification to a nose cone structure of an aircraft.

It is a further object of the present invention to provide a high resolution side-looking airborne radar antenna apparatus to collimate a microwave radar beam with very low-side lobes, especially toward the ground, thereby reducing ground clutter to essentially zero.

It is a further object of the present invention to provide an airborne high resolution side-looking radar antenna in the form of a modest antenna apparatus designed to achieve narrow radar beams.

According to the present invention, there is provided a high resolution side-looking radar antenna apparatus for aircraft, the apparatus comprising, in combination, a dielectric slim lens supported at a side of the fuselage of the aircraft facing outwardly above an airfoil to collimate electromagnetic wave energy for a narrow radar beam, a feed element supported by an airfoil of the aircraft at a remote location to the lens for directing electromagnetic wave energy toward the face surface of the lens, and a metallic reflector between the lens and the fuselage of the aircraft to reflect incident wave energy for a double-traversal of the lens.

In such an antenna apparatus, the slim dielectric lens may take the form of a composite of lens segments carried upon the side of the fuselage of the aircraft. The metallic reflector may be a planar configuration or a very shallow parabolic configuration. Moreover, the outer skin of the aircraft may be employed as a reflector. When the outer skin of the fuselage is used as a reflector, compensation for the curvature of the fuselage is by corrective adding of thickness to the dielectric lens material. The feed element, typically in the form of a feed horn, is housed within a streamlined enclosure to minimize drag at a relatively short distance, preferably at an outwardly-spaced location onto the airfoil surface of the aircraft wing. Thus, the present invention provides a low-loss microwave lens for a side-looking radar beam formation with a minimum of drag to the aircraft.

These features and advantages of the present invention as well as others will be more fully understood when the following description is read in light of the accompanying drawings, in which.

Figure 1:
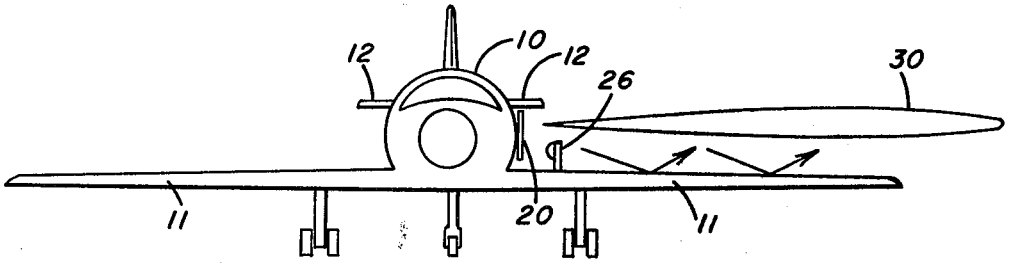
FIG. 1 is an elevational view wherein an aircraft is schematically illustrated in combination with a side-looking radar antenna apparatus of the present invention.
Figure 2:
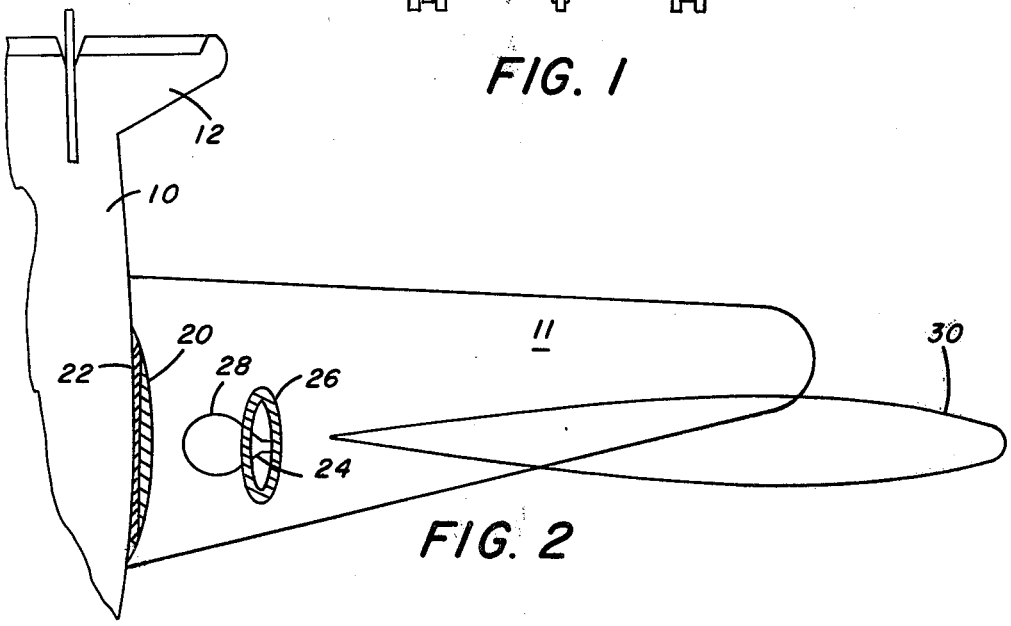
FIG. 2 is a plan view of the radar apparatus shown in relation to an aircraft.

As described hereinbefore, the antenna apparatus of the present invention is employed for side-looking airborne radar, particularly severe weather probes and hurricane mapping, wherein the antenna apparatus is highly effective and much less expensive than a conventional nose cone mounted paraboloid antenna. In FIGS. 1 and 2, there is illustrated a typical aircraft denoted by the usual fuselage 10 and airfoils, including wings 11 and tails 12. The skin of the fuselage and airfoils is metallic as is well known for modern aircraft, particularly jet-powered aircraft. The side-looking radar antenna apparatus of the present invention includes a slim dielectric lens 20 which may include a composite of lens segments mounted upon the fuselage of the aircraft. A metallic reflector 22 is disposed between the lens and the fuselage of the aircraft. This reflector may have a number of different forms including a planar metallic reflector, a very shallow parabolic reflector or even the metallic skin of the fuselage may be used as a reflector. In the latter case, the thickness of the dielectric lens is carefully varied across its face surface to effect phase corrections made necessary because of the curvature of the fuselage. A small feed element 24 is mounted a short distance of the order of 6 feet, depending upon the F/D ratio of the lens on the top airfoil surface of the wing 11. The feed element has a typical well-known configuration, such as a feed horn, which is housed within a streamlined housing 26 to minimize drag. The feed element is used to illuminate the lens-reflector combination to effect a double-traversal of the lens with the electromagnetic wave energy propagated from the horn. The pattern of wave energy from the horn is typically shown by the circular feed pattern 28 to impinge upon the face surface of the lens. The distance between the feed horn and the lens is chosen to correspond to the focal length of the lens. The pattern of reflected wave energy by the lens-reflector combination is a narrow beam, such as represented by lobe 30. It is preferred to include the standard forward-looking weather radar system including the usual antenna within the nose cone for use to acquire a broad-brush weather picture. The high-resolution side-looking radar antenna is used for precise probing and mapping of weather cells. Also, if Doppler capabilities are available in the radar system, the high resolution radar enables the mapping of wind velocities. In contradiction to the standard weather radar where the antenna is scanning, the side-looking airborne radar antenna of the present invention is not scanning but rather the entire aircraft becomes the scanning element by virtue of a circular flight path which is chosen about a weather cell.

For airborne surveillance radar of this type, it is vital to reduce the side-lobes in the lower hemisphere to the −60 to −80 db region in order to reduce ground clutter. An important feature of the present invention is the location of the antenna on the fuselage above the wing whereby the desired side-lobe levels can be achieved by using the wing as a radio-frequency shield which is clearly apparent from FIGS. 1 and 2. The resulting scan limitations are tolerable in most such radar systems or the limitations may be circumvented by flying the aircraft in a circle. In other words, scanning the entire aircraft. To utilize the circling airplane concept, one must employ a high-gain antenna over the wing of the aircraft. However, simpler antenna structures may be employed to permit using the scanning concept without investing in a complex antenna array.

Figure 3:
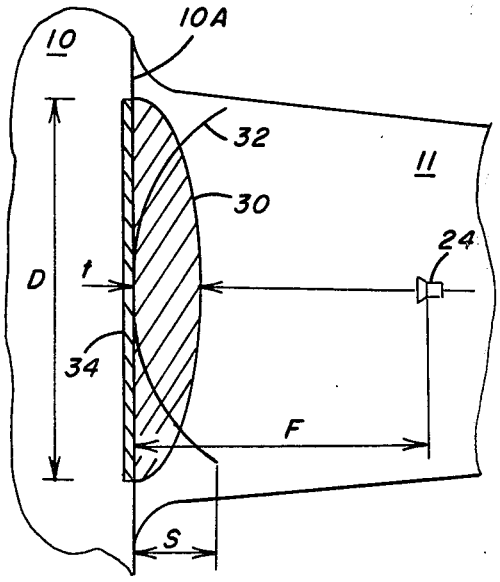
FIG. 3 is an enlarged plan view of a modified form of antenna apparatus.

As stated hereinbefore, an object of the present invention is the use of a low-loss microwave lens for side-looking beam formations with a minimum drag. In FIG. 3, there is illustrated one particular configuration of a lens 30 and an equivalent dish geometry superimposed by the parabolic curve 32. The reflector 34 is planar but, if desired, the metal skin 10A of the fuselage may be used to reflect the wave energy for a double-traversal of the lens. The fuselage of modern-day jet aircraft at the support site of the lens is non-planar, having a tubular configuration. The dielectric constant of the lens across the support site on the fuselage must be reduced and/or increased to maintain the desired focal point and collimating by the lens. The lens thickness and/or lens material may be changed for this purpose. The depth S of the dish is taken from the sagitta formula:

$$S = \frac{D^2}{8R} \tag{1}$$

where:

D is the diameter of the lens-dish; and

R is the radius.

Since R is equal to or approximately equal to 2F, then:

$$S = \frac{D^2}{16F} \tag{2}$$

where F is the focal length of the lens. Now, a lens with the same phase shift would have a thickness, t, of $$\phi_L = \phi_D,$$

or $$2\pi \frac{t}{\lambda'} = 2\pi \frac{S}{\lambda_o} \tag{3}$$

where $$\lambda' = \frac{\lambda_o}{\sqrt{\epsilon}}$$

is the wavelength in the lens medium, $\epsilon$. Thus:

$$t = \frac{S}{\lambda_o/\lambda'} = \frac{S}{\sqrt{\epsilon}} \tag{4}$$

Combining Equation (4) with Equation (2):

$$t = \frac{D^2}{16\sqrt{\epsilon}\,(F)} \tag{5}$$

or, $$t = \frac{D}{16\sqrt{\epsilon}\,(F/D)} \tag{6}$$

The ratios F/D are usually chosen to minimize feed horn spillover, adjust illumination taper, etc. With non-circular apertures, the ratios $F/D_H$ and $F/D_r$ are not equal and optimized only by making some difficult compromises. If one were to choose, for example, D equals 12 feet and F/D equals 0.8 with a polystyrene lens, the square root of $\epsilon$ equals 1.6, then:

t=0.59 feet (=7").

This provides a self-fairing beam-forming structure only 7 inches thick and 12 feet long lying close to the fuselage of the aircraft at a location which is near the center of gravity of the aircraft. The antenna structure is fed by a feed horn mounted on the wing about 7 feet from the lens. The lens is inherently streamlined but inherently heavy, e.g., approximately 500 pounds where polystyrene material is used at 70 pounds per cubic foot. The lens becomes retrolental since the microwave energy is passed twice through the half-lens. This reduces the weight of the lens to about one-half that required for the normal feed-from-behind-type lens configuration.

Figure 4:
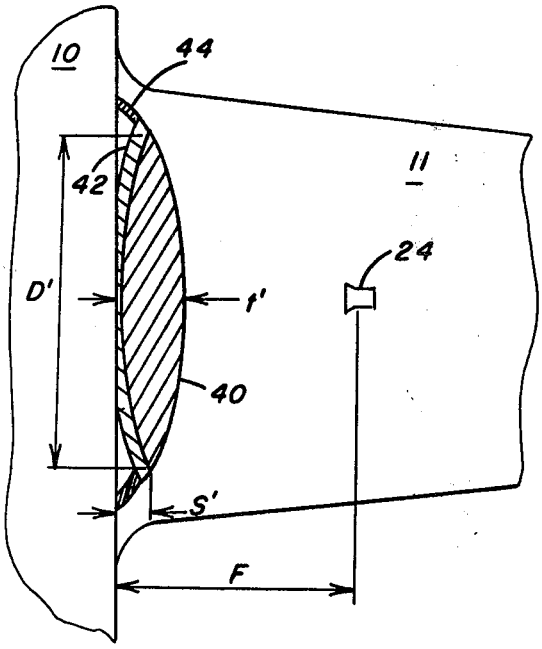
FIG. 4 is a view similar to FIG. 3 but illustrating a further modification to the antenna apparatus of the present invention.

As shown in FIG. 4, by combining the lens 40 and dish structure of reflector 42, the weight and drag can be further reduced. As shown, the lens 40 has a double-convex shape fitted within the reflector 42 which has a shallow parabolic shape. Thus, by setting t'=S'.

Now for a lens 3 feet by 12 feet:

$$M \approx \tfrac{1}{3}\rho wlh \tag{7}$$

≈500 pounds where $\rho$=70 pounds per cubic foot for polystyrene.

In the lens-loaded dish shown in FIG. 4:

$$S' + t' = \frac{D^2}{16F} \text{ but}$$

$$t' = (S'\sqrt{\epsilon}\,), \text{ therefore} \tag{8}$$

$$S' = \frac{D}{(1+\sqrt{\epsilon}\,)\,16\,F/D} \tag{9}$$

A specific example of such a lens according to FIG. 4, using polystyrene where $\sqrt{\epsilon}$=1.6,

D=12',

F/D=0.8 and

S' =t=4.3".

The weight of the lens has thus been reduced to 360 pounds but now requires a fairing 44 to smooth the airflow past the dish-lens structure. The fairings are annular shrouds to enclose the space between the outer edge of the lens and the fuselage with a streamlined configuration. From the foregoing, it is believed apparent to those skilled in the art that relatively large apertures comparable with the wing root chord can be configured to generate very sharp azimuth beams. Thus, the present invention provides that the straight planiform fuselage of a modern-day airliner together with the wing thereof can be modified in an airworthy fashion to produce a high-gain very low-side elevation lobe fixed beam using a single ray-fed lens structure which is essentially frequency insensitive. Thus, an essential part of the present invention is the use of the half-lens in a double-traversal over a flat metal reflector formed by the wing and the use of a similar type double-traversal lens in a metal parabolic dish to trim the aerodynamic cross section of the lens-reflector combination. While the present invention is particularly envisioned for use with airborne weather radar in an air-weather service or weather bureau aircraft, other applications may be suggested to those skilled in the art.

We claim as our invention:

1. A high resolution side-looking airborne radar antenna apparatus on an aircraft, said apparatus comprising, in combination, a metallic reflector attached to the fuselage of the aircraft facing outwardly above an airfoil thereof, a retrolental dielectric slim lens mounted superimposed onto said reflector to face outwardly above an airfoil of the aircraft, said lens having a varying dielectric constant across the face thereof to collimate incidental electromagnetic wave energy through a double traversal of the lens and reflection by said reflector for producing a very sharp azimuth radar beam, a feed horn facing said lens while supported by an airfoil of the aircraft at a remote outwardly-spaced location from said lens for utilizing the airfoil as a radio-frequency shield, and housing means on the top surface of the wing of the aircraft for said feed horn.

2. The apparatus according to claim 1 wherein said metallic reflector includes the metallic skin of the aircraft fuselage.

3. The apparatus according to claim 2 wherein said lens has a varying thickness for compensating for curvature of the fuselage at the support site for said lens and reflector.

4. The apparatus according to claim 2 wherein said lens has a varying dielectric constant for compensating for curvature of the fuselage at the support site for said lens and reflector.

5. The apparatus according to claim 1 wherein said metallic reflector is planar.

6. The apparatus according to claim 1 wherein said metallic reflector has a relatively shallow parabolic shape essentially corresponding to the face surface of said lens directed toward the fuselage of the aircraft.

7. The apparatus according to claim 1 further comprising fairings extending from the peripheral edge of said lens to the fuselage of the aircraft for smoothing airflow across said lens.

8. The apparatus according to claim 1 wherein said reflector defines a parabolic dish to trim the aerodynamic cross section of said lens carried thereby.

9. The apparatus according to claim 1 wherein said lens has a double-convex shape.

10. The apparatus according to claim 1 wherein said metallic reflector is non-planar.

11. A high resolution side-looking airborne radar antenna apparatus on an aircraft, said apparatus comprising, in combination, a relatively shallow parabolic metallic reflector attached to the fuselage of the aircraft facing outwardly above an airfoil thereof, a double convex retrolental dielectric slim lens mounted superimposed onto said reflector to face outwardly above an airfoil of the aircraft, said lens having a varying dielectric constant across the face thereof to collimate incidental electromagnetic wave energy through a double traversal of the lens and reflection by said reflector for producing a very sharp azimuth radar beam, a feed horn facing said lens while supported by an airfoil of the aircraft at a remote outwardly-spaced location from said lens for utilizing the airfoil as a radio-frequency shield, housing means on the top surface of the wing of the aircraft for said feed element, and fairings extending from the peripheral edges of said lens to the fuselage of the aircraft for smoothing the airflow across said lens.

* * * * *